US009236178B2

(12) United States Patent
Yang et al.

(10) Patent No.: US 9,236,178 B2
(45) Date of Patent: Jan. 12, 2016

(54) COIL COMPONENT AND MANUFACTURING METHOD THEREOF

(71) Applicant: Samsung Electro-Mechanics Co., Ltd., Gyeonggi-do (KR)

(72) Inventors: Ju Hwan Yang, Gyeonggi-do (KR); Sung Kwon Wi, Gyeonggi-do (KR); Jin Hyuck Yang, Gyeonggi-do (KR); Young Do Kweon, Gyeonggi-do (KR); Sang Moon Lee, Gyeonggi-do (KR)

(73) Assignee: Samsung Electro-Mechanics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/794,684

(22) Filed: Mar. 11, 2013

(65) Prior Publication Data

US 2014/0062636 A1 Mar. 6, 2014

(30) Foreign Application Priority Data

Aug. 29, 2012 (KR) ..... 10-2012-0094774

(51) Int. Cl.

| | |
|---|---|
| ***H01F 27/02*** | (2006.01) |
| ***H01F 17/04*** | (2006.01) |
| ***H01F 5/00*** | (2006.01) |
| ***H01F 17/00*** | (2006.01) |
| *H01F 27/29* | (2006.01) |

(52) U.S. Cl.

CPC ..... *H01F 17/04* (2013.01); *H01F 5/00* (2013.01); *H01F 17/0006* (2013.01); *H01F 27/02* (2013.01); *H01F 17/0013* (2013.01); *H01F 27/292* (2013.01); *H01F 2017/048* (2013.01)

(58) Field of Classification Search

CPC ..... H01F 5/00; H01F 27/00–27/36
USPC ..... 336/65, 83, 200, 232
See application file for complete search history.

(56) References Cited

U.S. PATENT DOCUMENTS

| | | | | |
|---|---|---|---|---|
| 7,477,127 | B2 * | 1/2009 | Kamijima | 336/206 |
| 2001/0017420 | A1 * | 8/2001 | Iwao et al. | 257/758 |

FOREIGN PATENT DOCUMENTS

| | | | |
|---|---|---|---|
| GB | 814300 | * | 6/1959 |
| KR | 10-2000-0051233 | A | 8/2000 |
| KR | 10-2004-0029592 | A | 4/2004 |
| KR | 10-2008-0075790 | A | 8/2008 |

* cited by examiner

*Primary Examiner* — Tuyen Nguyen

(74) *Attorney, Agent, or Firm* — McDermott Will & Emery LLP

(57) ABSTRACT

Disclosed herein are a coil component and a manufacturing method thereof. The coil component includes: an electrode body including coil electrodes disposed therein, the coil electrodes having an insulating film deposited on a surface thereof; and external terminals formed at both side portions of the electrode body and connected to the coil electrodes, wherein the electrode body is made of an insulating material with which magnetic powders are mixed, in order to improve impedance characteristics.

8 Claims, 2 Drawing Sheets

COIL COMPONENT AND MANUFACTURING METHOD THEREOF

CROSS REFERENCE(S) TO RELATED APPLICATIONS

This application claims the benefit under 35 U.S.C. Section 119 of Korean Patent Application Serial No. 10-2012-0094774, entitled "Coil Component and Manufacturing Method Thereof" filed on Aug. 29, 2012, which is hereby incorporated by reference in its entirety into this application.

BACKGROUND OF THE INVENTION

1. Technical Field

The present invention relates to a coil component and a manufacturing method thereof, and more particularly, to a coil component having improved impedance characteristics, and a manufacturing method thereof.

2. Description of the Related Art

An inductor element, which is one of important passive elements configuring an electronic circuit together with a capacitor, is used as a component removing a noise or configuring an LC resonant circuit.

The inductor element is divided into a winding type inductor element manufactured by winding a coil around a ferrite core or performing printing on the ferrite core and forming electrodes at both ends of the core, a stack type inductor element manufactured by printing internal electrodes on one surface of a magnetic sheet or a dielectric sheet and stacking the magnetic sheets or the dielectric sheets, and a thin film inductor element manufactured by plating coil shaped coil electrodes on a base substrate by a thin film process. Recently, in accordance with the request for miniaturization and slimness of a product, a demand for a chip type inductor element has significantly increased.

The inductor element as described above generally includes coil shaped internal electrodes vertically disposed in a plurality of layers in order to secure inductance capacity of a predetermined level and has a structure in which an insulating layer is applied between the respective internal electrodes in order to electrically insulate therebetween.

However, according to this structure, an insulating material configuring the insulating layer is filled between patterns of the internal electrodes, such that impedance characteristics of the inductor element are deteriorated.

In relation to this, Korean Patent Application No. 10-2002-0059899 (hereinafter, referred to as Related Art Document) has suggested a coil component in which an opening part is formed at the center of a non-magnetic layer having internal electrodes printed thereon and an internal electrode layer is formed in the opening electrode layer.

However, the coil component disclosed in Related Art Document in which only a portion of an internal structure is changed has a structural limitation in significantly improving impedance characteristics and requires a manufacturing process different from an existing process, such that the process is complicated and a manufacturing cost increases.

RELATED ART DOCUMENT

Patent Document (Patent Document 1) Korean Patent application No. 10-2002-0059899

SUMMARY OF THE INVENTION

An object of the present invention is to provide a manufacturing method of a coil component capable of improving impedance characteristics even in the case of using an existing process, and a coil component manufactured using the same.

According to an exemplary embodiment of the present invention, there is provided a coil component including: an electrode body including coil electrodes disposed therein, the coil electrodes having an insulating film deposited on a surface thereof; and external terminals formed at both side portions of the electrode body and connected to the coil electrodes, wherein the electrode body is made of an insulating material with which magnetic powders are mixed.

A particle size of the magnetic powder may be smaller than a distance between patterns of the coil electrode.

The magnetic powders may be formed of heterogeneous particles having particle sizes different from each other.

The magnetic powders may be formed of coarse particles having a particle size of 2 to 3 μm and micro particles having a particle size of 0.3 to 0.5 μm.

The magnetic powder may include at least any one of Mn—Zn based ferrite, Ni—Zn based ferrite, Ni—Zn—Mg based ferrite, and Mn—Mg—Zn based ferrite.

The insulating film may be made of an oxide formed by oxidizing the coil electrode.

The coil component may further include an insulating layer bonded to a lower surface of the coil electrode.

The coil electrodes may be configured in plural and vertically disposed in the electrode body in a height direction.

The coil component may be a thin film type coil component formed by disposing a magnetic substrate at a lower portion thereof and performing a thin film process.

According to another exemplary embodiment of the present invention, there is provided a manufacturing method of a coil component, including: (a) preparing a magnetic substrate; (b) forming a coil electrode and an external terminal on one surface of the magnetic substrate; (c) oxidizing a surface of the magnetic substrate on which the coil electrode is formed; and (d) applying a slurry in which magnetic powders and an insulating material are mixed with each other to the surface of the magnetic substrate so as to cover the coil electrode.

The manufacturing method may further include, after step (c), performing a plating process to form the external terminal at a predetermined height and applying the slurry in which the magnetic powders and the insulating material are mixed with each other up to a height of the external terminal.

The plating process is additionally performed after etching an insulating film formed on a surface of the external terminal in step (b).

The manufacturing method may further include applying an insulating layer to one surface of the magnetic substrate and forming the coil electrode and the external terminal on an upper surface of the insulating layer.

The coil electrode may be configured in a plurality of layers by repeatedly performing steps (b) to (d).

DESCRIPTION OF THE PREFERRED EMBODIMENTS

Figure 1:
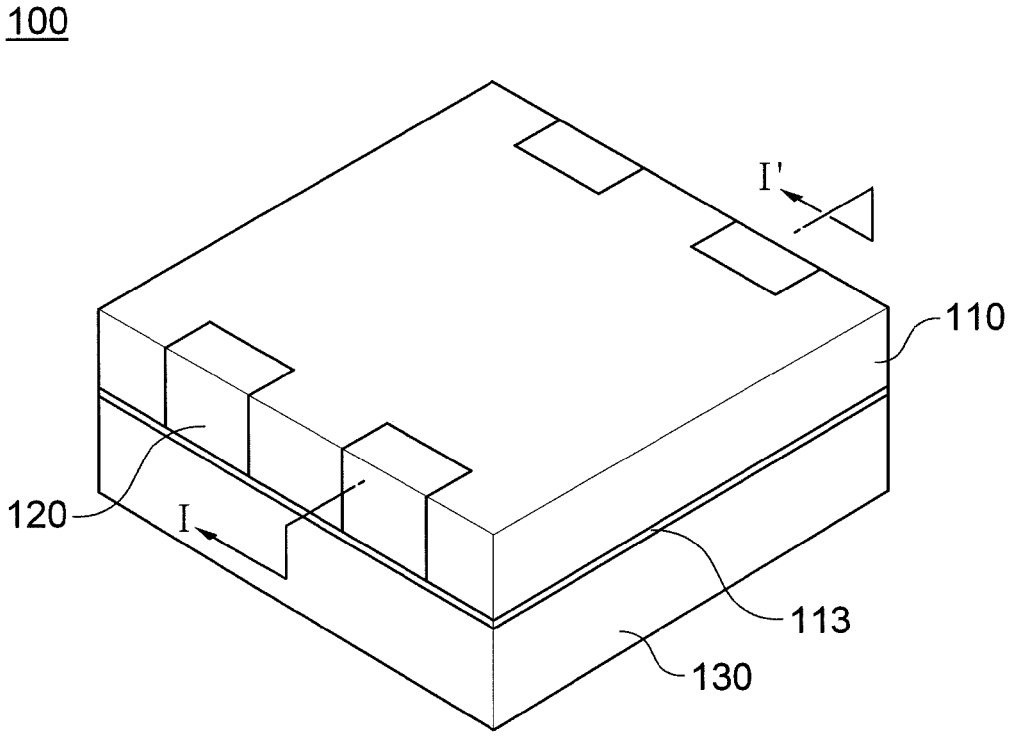
FIG. 1 is a perspective view of an appearance of a coil component according to an exemplary embodiment of the present invention.

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art. Like reference numerals throughout the description denote like elements.

Terms used in the present specification are for explaining exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

Hereinafter, a configuration and an acting effect of exemplary embodiments of the present invention will be described in more detail with reference to the accompanying drawings.

Figure 2:
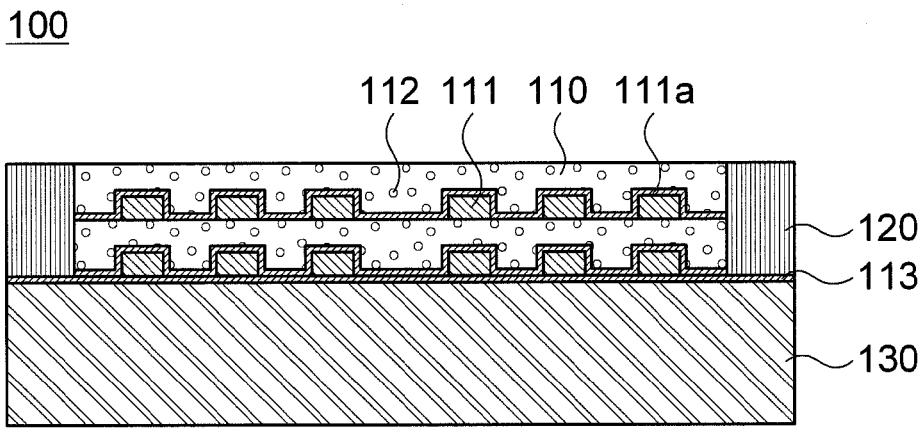
FIG. 2 is a cross-sectional view taken along the line I-I' of FIG. 1.

FIG. 1 is a perspective view of an appearance of a coil component 100 according to an exemplary embodiment of the present invention; and FIG. 2 is a cross-sectional view taken along the line I-I' of FIG. 1. Additionally, components shown in the accompanying drawings are not necessarily shown to scale. For example, sizes of some components shown in the accompanying drawings may be exaggerated as compared with other components in order to assist in the understanding of the exemplary embodiments of the present invention.

Referring to FIGS. 1 and 2, the coil component 100 according to the exemplary embodiment of the present invention may be configured to include an electrode body 110 including coil electrodes 111 disposed therein and external terminals 120 formed on both side portions of the electrode body 110.

The electrode body 110 may be formed by disposing a magnetic substrate 130 at a lower portion thereof and performing a thin film process using the magnetic substrate 130 as a support member. Therefore, the coil component 100 according to the exemplary embodiment of the present invention may be a thin film type coil component 100 including the magnetic substrate 130.

A thin insulating film 111*a* may be formed on a surface of the coil electrode 111 (more specifically, an upper surface and both sides of the coil electrode 111).

The insulating film 111*a* may be made of an oxide formed by oxidizing the coil electrode 111. Therefore, it is preferable that the coil electrode 111 is made of at least one selected from a group consisting of aluminum (Al), magnesium (Mg), manganese (Mn), zinc (Zn), titanium (Ti), hafnium (Hf), tantalum (Ta), and niobium (Nb) that have excellent conductivity and may be anodized, or an alloy of at least two thereof.

As an example, in the case in which the coil electrode 111 is made of aluminum (Al), the insulating film 111*a* may be made of alumina ($Al_2O_3$) formed by anodizing aluminum (Al).

The coil electrodes 111 may be configured in plural and vertically disposed in a height direction, as shown in FIG. 2. In this case, the coil electrodes 111 of each layer may be connected to each other through a via (not shown) to form a single coil or be electromagnetically coupled to each other without a separate via to be operated as a common mode filter. In this case, the thin insulating film 111*a* may be formed on the surface of the coil electrodes 111 of each layer, as described above.

Further, although not shown in FIGS. 1 and 2 in order to make the gist of the present invention obvious, one end of the coil electrode 111 may be directly connected to an exposed electrode (not shown) formed to be exposed at a side portion of the electrode body 110 and the other end thereof may be connected to another exposed electrode through a via (not shown). The exposed electrodes are connected to the external terminals 120, respectively, such that the coil electrodes 111 are electrically connected to the external terminals 120.

The electrode body 110 may be made of a mixture of a non-magnetic insulating material including at least one of polyimide, an epoxy resin, benzocyclobutene (BCB), and other polymer, and magnetic powders 112.

As a raw material of the magnetic powder 112, Ni—Zn, Mn—Zn based ferrite, Ni—Zn based ferrite, Ni—Zn—Mg based ferrite, or Mn—Mg—Zn based ferrite that has high electrical resistance and low magnetic force loss and may easily design impedance through a composition change, or a mixture thereof may be used. However, the raw material of the magnetic powder 112 is not limited thereto. That is, ferrite made of an appropriate material according to magnetic characteristics required in the coil component may be used as the raw material of the magnetic powder 112.

The present invention is characterized in that a particle size of the magnetic powders 112 is smaller than a distance between patterns of the coil electrode 111. Therefore, as shown in FIG. 2, the magnetic powders 112 are disposed between the patterns of the coil electrode 111. Therefore, the coil component 100 according to the exemplary embodiment of the present invention may have impedance characteristics significantly improved as compared with a coil component according to the related in which the coil electrode is simply applied with an insulating layer.

Meanwhile, as described above, since the insulating film 111*a* is formed on the surface of the coil electrode 111, an electrical short-circuit between the coil electrode 111 and the magnetic powder 112 does not occur.

In still another exemplary embodiment of the present invention, the magnetic powders 112 may be formed of heterogeneous particles having particle sizes smaller than the distance between the patterns of the coil electrode 111 and different from each other.

More specifically, the magnetic powders 112 may be formed of coarse particles having a particle size of 2 to 3 μm and micro particles having a particle size of 0.3 to 0.5 μm. In this case, the micro particles are positioned between the coarse particles, such that a packing factor of the magnetic powders 112 is increased, thereby making it possible to further improve the impedance characteristics.

Meanwhile, the coil component 100 may further include an insulating layer 113 bonded to a lower surface of the coil electrode 111. Since it is difficult to form an insulating film on the lower surface of the coil electrode 111 through oxidation, the insulating layer 113 bonded to the lower surface of the coil electrode 111 is provided, thereby making it possible to secure an insulating property between the coil electrode 111 and the magnetic powder 112.

Hereinafter, a manufacturing method of a coil component 100 according to the exemplary embodiment of the present invention will be described.

FIGS. 3 to 7 are views sequentially showing processes of a manufacturing method of a coil component 100 according to the exemplary embodiment of the present invention.

Figure 3:
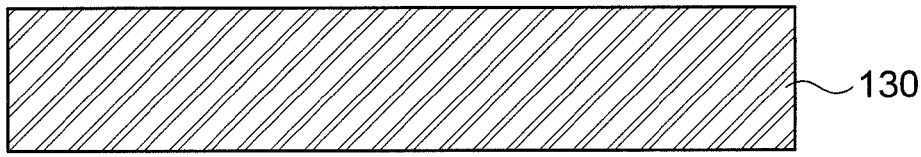
FIGS. 3 to 7 are views sequentially showing processes of a manufacturing method of a coil component according to the exemplary embodiment of the present invention.

In the manufacturing method of a coil component according to the exemplary embodiment of the present invention, a step of preparing a magnetic substrate 130 made of a magnetic material having magnetic permeability is first performed, as shown in FIG. 3.

Figure 4:
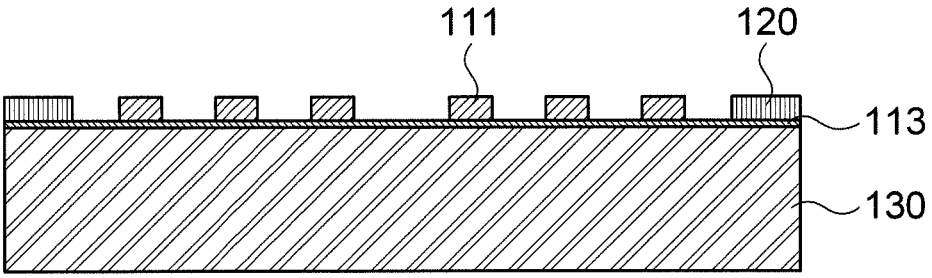

Then, as shown in FIG. 4, a step of forming a coil electrode 111 and an external terminal 120 on one surface of the magnetic substrate 130 is performed. This step may be performed by a plating process such as a generally well-known additive process, subtractive process, semi-additive process, and the like.

In this case, in order to electrically insulate between the magnetic substrate 130 and the coil electrode 111 and between the magnetic substrate 130 and the external electrode 120, the insulating layer 113 may be applied to one surface of the magnetic substrate 130 and the coil electrode 111 and the external terminal 120 may be formed on an upper surface of the insulating layer 113.

The insulating layer 113 may be made of polyimide, an epoxy resin, benzocyclobutene (BCB), or the like, having an excellent electrical insulating property. In addition, the insulating layer may be formed by a well-known method in the art such as a general depositing method or a solvent process, for example, a spin coating method, a dip coating method, a doctor blading method, a screen printing method, an inkjet printing method, a heat transfer method, or the like.

Figure 5:
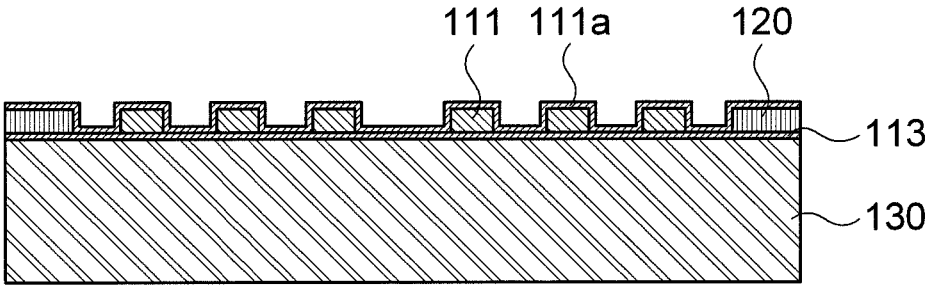

After the coil electrode 111 and the external terminal 120 are formed, as shown in FIG. 5, a step of oxidizing a surface of the magnetic substrate 130 on which the coil electrode 111 is formed.

Since the coil electrode 111 and the external terminal 120 are made of a metal material (any one of aluminum (Al), magnesium (Mg), manganese (Mn), zinc (Zn), titanium (Ti), hafnium (Hf), tantalum aluminum (Ta), niobium (Nb), or an alloy of at least two thereof) that may be anodized, when an oxidizing process such as an anodizing process, a plasma electrolytic oxidizing process, or the like, is performed, the insulating film 111*a* made of a metal oxide may be deposited and formed on surfaces of the coil electrode 111 and the external terminal 120.

Figure 6:
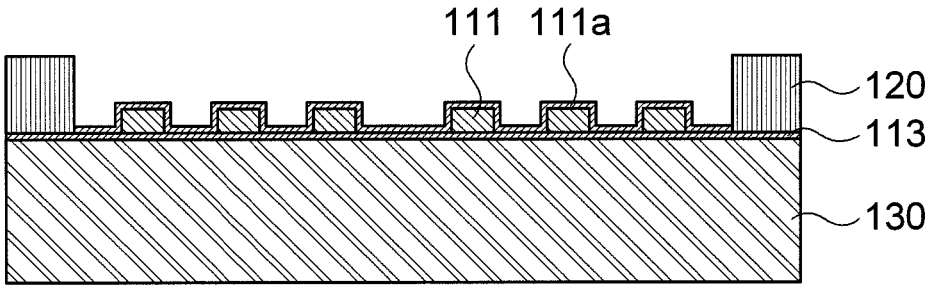

Meanwhile, the above-mentioned plating process is repeated, such that the external terminal 120 may be plated at a predetermined height as shown in FIG. 6. In this case, before the plating process is performed, a step of etching the insulating film 111*a* formed on the surface of the external terminal 120 by the oxidizing process may be performed.

That is, as shown in FIG. 5, when the surface of the magnetic substrate 130 is oxidized, since the insulating film 111*a* is deposited and formed on the surfaces of the external terminal 120 as well as the coil electrode 111, the insulating film 111*a* on the surfaces of the external terminal 120 is removed by the etching process and the plating process is then performed additionally, such that the external terminal 120 is made only of a metal.

Figure 7:
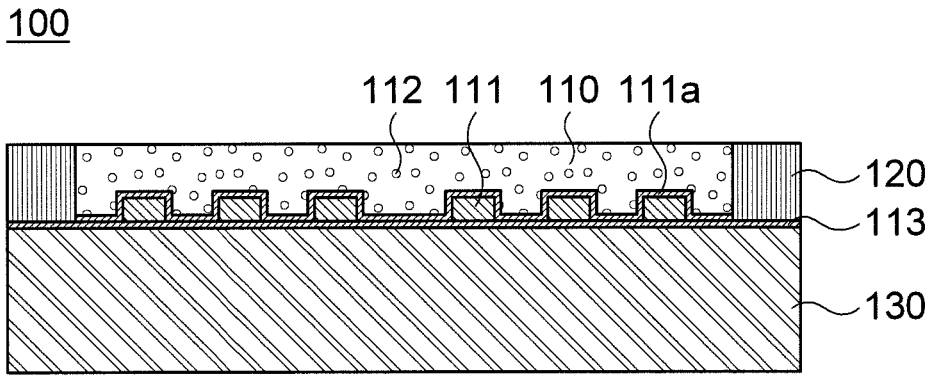

Then, as shown in FIG. 7, the electrode body 110 covering the coil electrode 111 is formed, such that the coil component 100 according to the exemplary embodiment of the present invention is finally completed.

The electrode body 110 may be formed by mixing the above-mentioned ferrite raw material and materials such as various polymers, a binder, a plasticizer, and the like, using a ball mill, or the like, grinding the mixture, applying a slurry manufactured through the above-mentioned process to the surface of the magnetic substrate 130, and then pressing and sintering the slurry. Here, the slurry may be applied at the same height as that of the external terminal 120.

Since the particle sizes of the magnet powders 112 included in the slurry are smaller than the distance between the patterns of the coil electrode 111, the magnetic powders 112 are positioned between the patterns of the coil electrode 111. Therefore, the coil component 100 according to the exemplary embodiment of the present invention manufactured by the processes of FIGS. 3 to 7 may have the impedance characteristics significantly improved as compared with the coil component according to the related art.

Meanwhile, although the coil component including a single coil electrode 111 has been illustrated in FIGS. 3 to 7 in order to clearly describe the manufacturing process, the coil electrode 111 may also be configured in a plurality of layers by applying the slurry for forming the electrode body 110 only at a predetermined height in the process of FIG. 7, applying the insulating layer 113 on the slurry, and then performing repeatedly the processes of FIGS. 4, 5, and 7.

In addition, after the electrode body 110 is formed, a polishing process may be additionally performed to planarize a surface of the electrode body 110 or a nickel/gold plating process may be performed to additionally form a nickel/gold plated layer on the surface of the external terminal 120.

With the coil component and the manufacturing method thereof according to the exemplary embodiment of the present invention, since the magnetic powders may be positioned between the patterns of the coil electrode, the impedance characteristics of the coil component may be significantly improved.

In addition, since an existing process technology is used as it is, productivity may not be deteriorated and the product may be implemented at a low cost.

The above detailed description has illustrated the present invention. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A coil component comprising:

an electrode body including coil electrodes disposed therein, the coil electrodes having an insulating film deposited on a surface thereof;

external terminals formed at both side portions of the electrode body and connected to the coil electrodes;

an insulating layer bonded to a lower surface of the coil electrodes; and a magnetic substrate disposed to a lower surface of the electrode body, wherein the electrode body is made of an insulating material with which magnetic powders are mixed, and wherein the insulating layer is disposed between the magnetic substrate and the coil electrodes and between the magnetic substrate and the external terminals.

2. The coil component according to claim 1, wherein the magnetic powders have a particle size smaller than a distance between patterns of the coil electrodes.

3. The coil component according to claim 1, wherein the magnetic powders are formed of heterogeneous particles having particle sizes different from each other.

4. The coil component according to claim 3, wherein the magnetic powders are formed of coarse particles having a particle size of 2 to 3 μm and micro particles having a particle size of 0.3 to 0.5 μm.

5. The coil component according to claim 1, wherein the magnetic powders include at least any one of Mn—Zn based ferrite, Ni—Zn based ferrite, Ni—Zn—Mg based ferrite, and Mn—Mg—Zn based ferrite.

6. The coil component according to claim 1, wherein the insulating film is made of an oxide formed by oxidizing the coil electrodes.

7. The coil component according to claim 1, wherein the coil electrodes are configured in plural and vertically disposed in the electrode body in a height direction.

8. The coil component according to claim 1, wherein the coil electrodes are a thin film type coil component formed by disposing the magnetic substrate at a lower portion thereof and performing a thin film process.

* * * * *